US006543874B2

(12) United States Patent
Matsumoto

(10) Patent No.: US 6,543,874 B2
(45) Date of Patent: Apr. 8, 2003

(54) LIQUID DROPLET EJECTING APPARATUS

(75) Inventor: Nobuo Matsumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/120,783

(22) Filed: Apr. 12, 2002

(65) Prior Publication Data

US 2002/0154186 A1 Oct. 24, 2002

(30) Foreign Application Priority Data

Apr. 13, 2001 (JP) ..... 2001-114984

(51) Int. Cl.[7] ..... B41J 29/393; B41J 29/38
(52) U.S. Cl. ..... 347/19; 347/14
(58) Field of Search ..... 347/19, 14, 23, 347/12, 10, 11, 8, 9, 15, 16, 17, 13, 20, 47, 43, 37, 42

(56) References Cited

U.S. PATENT DOCUMENTS 5,583,552 A * 12/1996 Mutoh ..... 347/14

* cited by examiner

*Primary Examiner*—Lamson Nguyen
*Assistant Examiner*—Charles W. Stewart, Jr.
(74) *Attorney, Agent, or Firm*—Whitham, Curtis & Christofferson, P.C.

(57) ABSTRACT

The liquid droplet ejecting apparatus includes an ejecting head having a plurality of nozzles for ejecting liquid droplets and a plurality of liquid droplet ejecting devices arranged in correspondence with the plurality of nozzles, respectively, and driven with modulation in response to signals, a detection unit for detecting a condition of a virtual surface opposed to the ejecting head or an angle detection unit for detecting an angle made by a direction, in which liquid droplets are ejected from at least a part of the plurality of nozzles of the ejecting head, and a preset reference direction, and a unit for prohibiting liquid droplet ejection from at least a part of the plurality of nozzles of the ejecting head depending on a result of detection by the detection unit or an angle detected by the angle detection unit.

10 Claims, 5 Drawing Sheets

LIQUID DROPLET EJECTING APPARATUS

BACKGROUND OF THE INVENTION

1. Field of the Invention

The present invention relates to a liquid droplet ejecting apparatus for use in an ink jet printer or the like, and more specifically, to a liquid droplet ejecting apparatus with high level safety so that inadvertent ejection of ink is prevented in a hand-held type ink jet printer or the like.

2. Description of the Related Art

There has been utilized a thermal ink jet system in various types or printer (See JP 48-9622 A, JP 54-51837 A, etc.), in which partial evaporation of ink is rapidly effected through heating with a heater to thereby cause ink droplets to be ejected through nozzles by the expansion force, etc.

Further, a printer is known, which utilizes an ink jet that oscillates an oscillation plate by driving means such as static electricity or a piezoelectric element to thereby cause ink droplets to be ejected through nozzles by the oscillation energy (See JP 11-207956 A, JF 11-309850 A, etc.).

In ink jet printers described above, generally, an ink receiving member, namely a recording medium such as paper for recording, recording sheet, image receiving paper and image receiving medium (hereinafter represented by a recording sheet), is fed into the apparatus, and image recording is performed while conveying the member or medium.

For example, in a case of a printer using a so-called line head type ink jet recording head (hereinafter referred to as recording head), in which nozzles for ejecting ink are arranged beyond one side or the recording sheet, the recording head is stationary; the recording sheet is situated in a predetermined recording position; and an image is recorded on the entire surface of the recording sheet by continuously conveying (scan-conveying) the sheet in a direction perpendicular to the direction in which the nozzles are arranged.

In a case of a so-called serial type printer that is widely available, the recording sheet is intermittently conveyed at a predetermined pitch corresponding to the nozzle arrangement length, and, while the conveyance of the recording sheet is at rest, scanning is effected with the recording head in a direction perpendicular to the nozzle arrangement direction to perform image recording; by repeating the operation, an image is recorded on the entire surface of the recording sheet.

Further, an electronic stamp type ink jet printer is also known, which does not take in the recording medium such as a recording sheet but which is situated in a position corresponding to the recording medium to record an image.

For example, JP 3-261560 A discloses a planar printer in which the recording head (printer) main body on which nozzles are arranged in a matrix-like fashion (two-dimensionally) is placed on an arbitrary recording sheet, two-dimensional printing (image recording) being effected by ink jet.

In such an electronic stamp type printer, positioning is performed on the printer with respect to the recording sheet (recording medium) prior to image recording, whereby image recording (ejection of liquid droplets) is effected with the recording sheet facing the nozzles of the recording head.

Thus, unlike a printer which performs image recording while conveying a recording sheet taken therein, as is the case with the aerial type printer referred to above, this type of printer is advantageously capable of performing image recording without being restricted in terms of the size, configuration, thickness, rigidity (toughness or stiffness, for instance), etc. of the recording sheet. Further, since the recording object is not put into the printer, it is advantageously possible to employ various objects other than a recording Sheet, such as a wall and a three-dimensional object, as a recording medium and perform image recording thereon.

In this type of printer, such as an electronic stamp, ink is ejected into an open space, so that it is possible to eject ink onto an arbitrary location according to the position, situation, orientation, etc. of the printer positioned.

On the other hand, it can happen that ink is inadvertently ejected in unintended situations. For example, ink can be ejected before the recording head has been correctly opposed to the recording sheet. In such cases, ink can adhere to an object other than the image recording object, such as the skin or clothes of a person or a piece of furniture. Further, if it does not adhere to an object other than the recording object, ink sprayed into the air will, though not poisonous, undesirably pollute the environment.

SUMMARY OF THE INVENTION

The present invention has been made with a view toward solving the above problem in the prior art. It is an object of the present invention to provide a liquid droplet ejecting apparatus, which ejects liquid droplets with a modulation in response to a signal and is used in, for instance, such an ink jet printer as the above-mentioned electronic stamp, in which ink is ejected basically into an open space, which apparatus is of so high-level safety that it makes it possible to prevent liquid droplets from being inadvertently ejected when, for example, the liquid droplet ejecting head has not been correctly opposed to the object of liquid droplet ejection and to prevent consequently liquid droplets from adhering to an unwanted place or being sprayed into the air.

In order to attain the object described above, the first aspect of the invention provides a liquid droplet ejecting apparatus comprising an ejecting head having a plurality of nozzles for ejecting liquid droplets and a plurality of liquid droplet ejecting devices arranged in correspondence with the plurality of nozzles, respectively, and driven with modulation in response to signals, a detection unit for detecting a condition of a virtual surface opposed to the ejecting head, and a unit for prohibiting liquid droplet ejection from at least a part of the plurality of nozzles of the ejecting head depending on a result of detection by the detection unit.

In the liquid droplet ejecting apparatus, it is preferable that the detection unit is either a unit for detecting a human body, a unit for measuring a distance between an object existing in a liquid droplet ejection region for the plurality of nozzles of the ejecting head and the ejecting head, or a variation detection unit for detecting variations in a condition of a recording medium to be recorded existing in a liquid droplet election region for the plurality of nozzles of the ejecting head.

In order to attain the object described above, the second aspect of the invention provides a liquid droplet ejecting apparatus comprising an ejecting head having a plurality of nozzles for ejecting liquid droplets and a plurality of liquid droplet ejecting devices arranged in correspondence with the plurality of nozzles, respectively, and driven with modulation in response to signals, an angle detection unit for detecting an angle made by a direction, in which liquid droplets are ejected from at least a part of the plurality of nozzles of the ejecting head, and a preset reference direction, preferably, for instance, a vertical direction, and a unit for prohibiting liquid droplet ejection from at least a part of the plurality of nozzles of the ejecting head depending on an angle detected by the angle detection unit.

In the liquid droplet ejecting apparatus according to the first and second aspects of the invention, it is preferable that liquid droplets are ejected from the ejecting head into an open space.

It is also preferable that the liquid droplets are ink droplets, and wherein the liquid droplet ejecting apparatus is an ink jet printer.

BRIEF DESCRIPTION OF THE DRAWINGS

FIGS. 1A, 1B, and 1C are conceptual drawings showing an example of an ink jet printer according to the present invention, of which FIG. 1A is a side view, FIG. 1B is a front view, and FIG. 1C is a bottom view;

FIGS. 4A and 4B are conceptual drawings showing another example of an ink jet printer according to the present invention, of which FIG. 4A is a plan view, and FIG. 4B is a side view;

FIGS. 5A and 5B are conceptual drawings showing another example of an ink jet printer according to the present invention, of which FIG. 5A is a side view, and FIG. 5B is a front view.

DESCRIPTION OF THE PREFERRED EMBODIMENTS

Preferred embodiments of the liquid droplet ejecting apparatus of the present invention will now be described in detail with reference to the accompanying drawings.

Figure 1A:
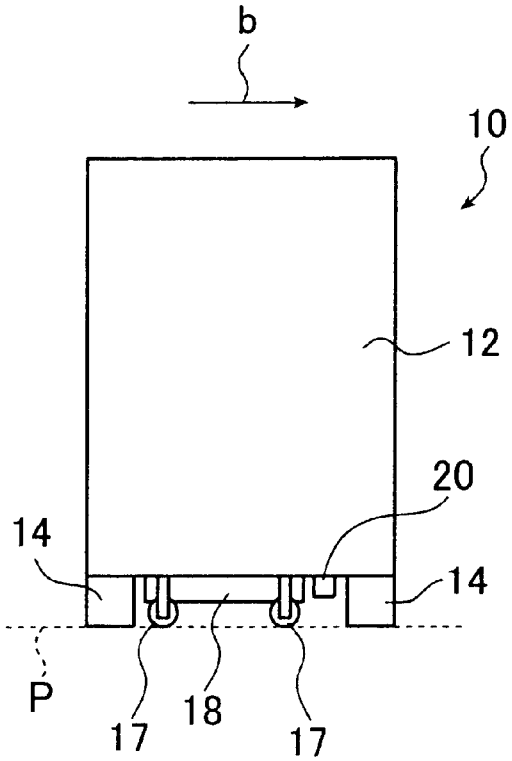
Figure 1B:
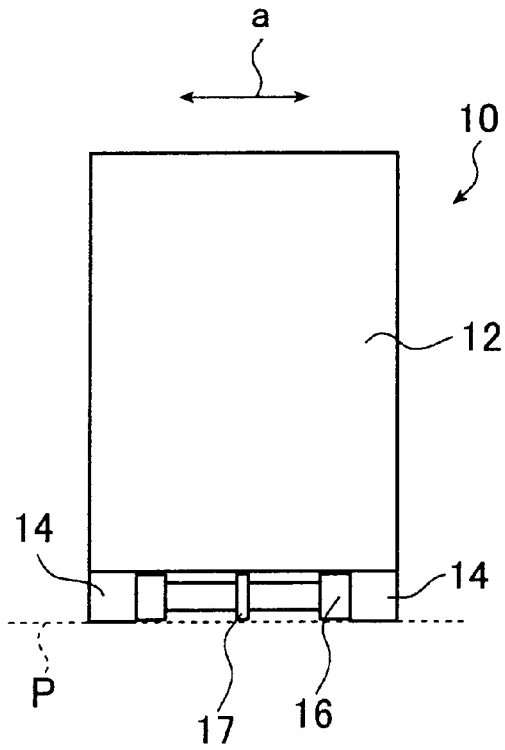
Figure 1C:
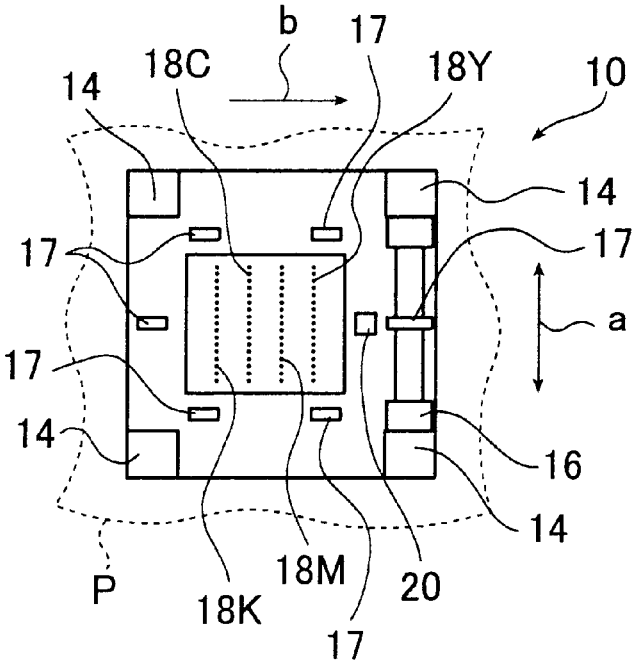

FIGS. 1A, 1B, and 1C are conceptual drawings showing an embodiment of an ink jet printer utilizing the liquid droplet ejecting apparatus of the present invention. FIG. 1A is a side view (as seen from the direction of the nozzle row described below), FIG. 1D is a front view (as seen from the direction of scanning described below), and FIG. 1C is a bottom view (as seen from the image receiving sheet).

The ink jet printer (hereinafter referred to as printer) 10 shown in FIGS. 1A, 1B, and 1C basically comprises a main body 12, leg portions 14, rollers 16, auxiliary wheels 17, an ink jet recording head (hereinafter referred to as recording head) 18, and an IR (infrared rays) sensor 20.

The printer 10 records images on a recording medium other than a human body (a recording sheet P in the example shown). The user brings the leg portions of the printer 10 into contact with the recording medium (the recording sheet P), with the ink ejecting surface facing the medium, and manually moves the printer 10 (performs scanning) in a predetermined direction indicated by the arrow b (hereinafter referred to as the scanning direction) which is perpendicular to the direction of nozzle arrangement in the recording head 18 (direction indicated by the arrow a and hereinafter referred to as the nozzle row direction) to record thereby a full-color image on the recording medium (the recording sheet P).

The main body 12 is a substantially square-prism-like casing. As shown in the block diagram of FIG. 2, it has the following components on the inside or outside: a CPU 30 for controlling the printer 10 as a whole, a driver 32 for the recording head 18, a detection level setting device 36, an abnormality indicator 38, a recording instruction switch (SW) 40, a data input portion 42, a data memory 44, an indicator 46, and a forced recording switch (SW) 48. These components will be described below together with the operation of the printer 10.

On the inner side (or outer side) of the main body 12, there is mounted an ink tank for supplying ink to the recording head 18. The configuration of the main body 12 is not restricted to the substantially square-prism-like configuration.

The leg portions 14 are fixed to the four corners of the lower surface (surface opposed to the recording sheet P, i.e, the surface on which the ink jet recording head 18 is arranged) of the main body 12. In the printer 10 shown, the four log portions 14 (or, in place of two leg portions 14, the rollers 16 described below) are brought into contact with the recording sheer p (e.g., by placing them on the sheet), whereby an appropriate distance is maintained between the ink jet recording head 18 and the recording sheet P.

Preferably, on the lower surface of the main body 12 are provided auxiliary wheels 17 for preventing the recording sheet P from rising and for keeping it immovable in the target position, which ink droplets should reach, for ink ejection from the recording head 18 so as to allow a high quality image to be recorded. Basically, the auxiliary wheels 17 may consist of rollers rotating in the scanning direction. In the case in which the auxiliary wheels may come into contact with the recording sheet P after image recording (after ink reception), it is preferred that the wheels have a small area of contact with the recording sheet P. In view of this, the auxiliary wheels preferably consist, for example, of spur-like rollers or knurl rollers.

A pair of leg portions 14 opposed to each other in the nozzle row direction (the direction perpendicular to the plane of FIG. 1A) (i.e., the leg portions on the right-hand side in FIGS. 1A and 1C and on the front side in FIG. 1B) support rollers 16, which are slightly protruding beyond the leg portions 14 in the ink ejecting direction (hereinafter referred to as the downward direction), rotatably on a shaft between them. That is, the rollers 16 rotate in the scanning direction (in the direction perpendicular to the plane of FIG. 1B).

Figure 2:
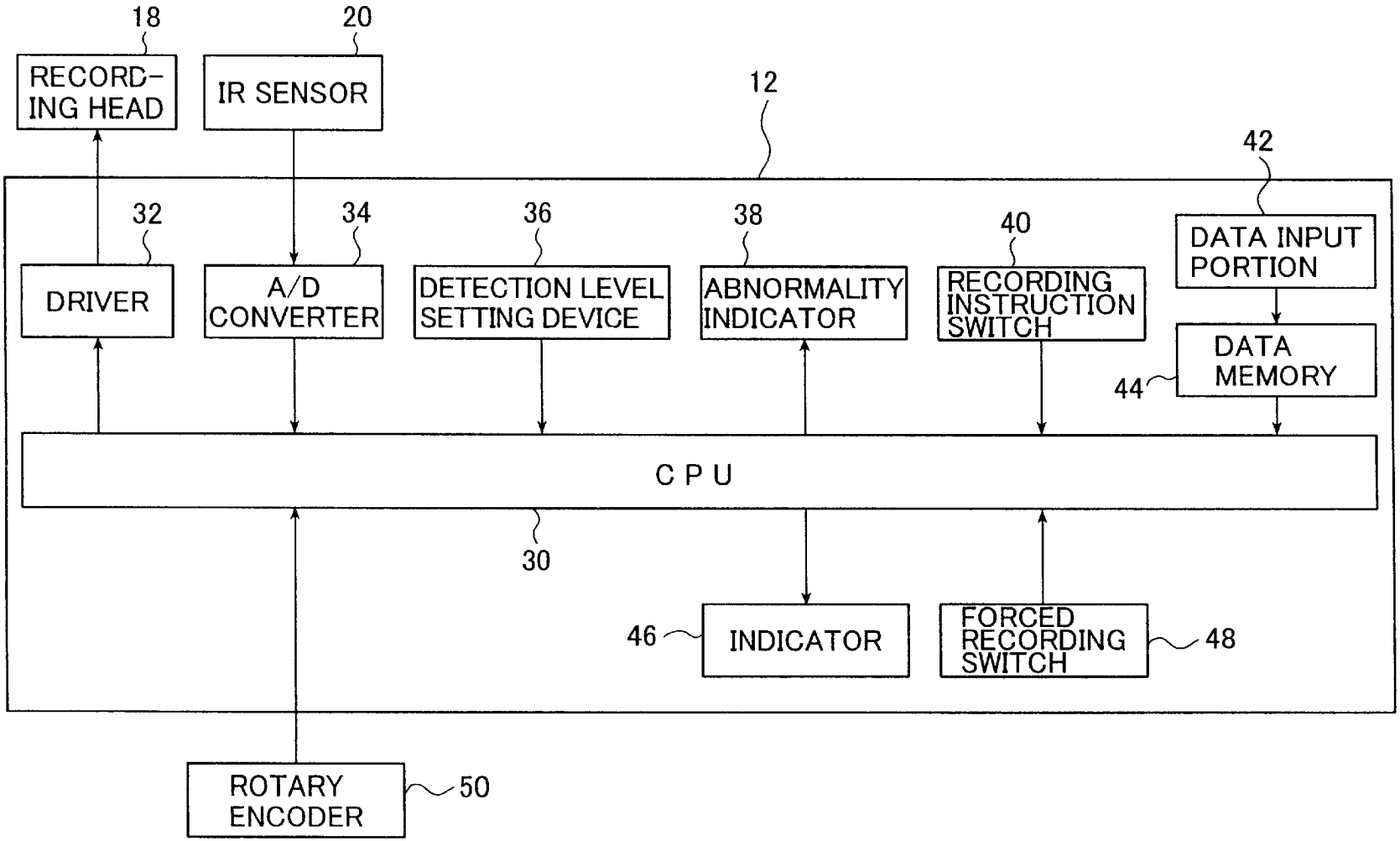
FIG. 2 is a block diagram of the ink jet printer shown in FIGS. 1A, 1B, and 1C.

Further, a rotary encoder 50 is mounted to the rollers 16 (i.e., to the rotation shaft thereof), and generates pulse signals according to the rotation of the rollers 16 as the printer 10 moves in the scanning direction, the pulse signals being transmitted to the CPU 30 (see FIG. 2).

On the lower surface of the main body 12, the recording head 18 is arranged.

In the example shown, the recording head 18 is provided such that ink is ejected from the main body 12 in the direction perpendicular to the lower surface of the main body 12. That is, ink is ejected into the open space outside the printer 10.

The recording head 18 is a well-known (ink jet) recording head having nozzles for ejecting ink and ink ejecting devices corresponding to the respective nozzles, and has a nozzle row in which a large number of nozzles are arranged in the nozzle row direction (the direction indicated by the arrow a).

In the example shown, there are provided four nozzle rows arranged in the scanning direction (indicated by the arrow b): a nozzle row 18Y for ejecting Y (yellow) ink, a nozzle row 18M for ejecting M (magenta) ink, a nozzle row 18C for ejecting C (cyan) ink, and a nozzle row 18K for ejecting K (black) ink The printer 10 is placed on the recording sheet P, and moved in the scanning direction (indicated by the arrow b) by the user, whereby two-dimensional scanning is effected on the recording sheet P by the nozzle rows of the recording head 18.

The CPU 30 detects the amount by which the printer 10 moves (scanning amount) through the pulse signals generated by the rotary encoder 50 during scanning, and adjusts the ink ejecting timing in synchronism with the movement of the printer 10. In addition, modulation is effected in accordance with the image to be recorded, and the recording head 18 is driven via the driver 32 so that it may eject ink in respective colors with modulation, whereby a full-color image is recorded on the recording sheet P with Y, M, C and K ink. Further, as will be describe below, in the example shown, IR light measurement by an IR sensor 20 is effected in accordance with the pulse signals generated in the rotary encoder 50.

In this way, the fluctuations in the speed at which the printer 10 is moved by the user is compensated for, whereby image recording can be performed in an appropriate manner and erroneous ejection of ink is reliably prevented.

While the printer 10 shown records an image by being moved in the direction of the arrow b, this should not be construed restrictively. In the present invention, the printer may also be moved in both ways in the scanning direction for image recording.

As stated above, in the printer 10 of the present invention, the recording head 18 may be a well-known ink jet recording head.

Thus, the recording head 18 may be a so-called top shooter type (face ink jet) which ejects ink in a direction perpendicular to the substrate, or a so-called side shooter type (edge ink jet) which ejects ink in a direction parallel to the substrate. Further, it may be a so-called thermal ink jet which ejects ink through heating by a heater, or a recording head of the type which oscillates an oscillation plate in the ink chamber by using a piezoelectric element or static electricity or the like, and elects ink by the force thus obtained.

Further, it is also possible to provide, in addition to the ink nozzle rows for the above four colors, ink nozzle rows for light C, light M, etc. Alternatively, it is also possible to adopt a monochrome printer that ejects, for example, K ink only.

The IR sensor 20 is arranged on the lower surface of the main body 12. To secure a higher level of safety, the IR sensor 20 is preferably arranged in the vicinity of the recording head 18.

In the printer 10 shown, the IR sensor 20 is a detection unit for detecting the condition of the virtual surface opposed to the recording head (ejecting head) 18, more specifically, for detecting the condition of the (target) position or region for ink (liquid droplet) ejection from the recording head 18. In the present invention, the position for ink ejection means the target position (surface) which ink droplets from the recording head 11 should reach, and the region for ink ejection or the ink ejection region means the region, in which ink (droplet) is ejected from the recording head 18, flies and reaches the target to be recorded or can fly, including the ink ejecting surface (for example, the surface (on the ink ejecting side) of the orifice plate in the recording head 18, in which plate nozzles are formed), the surface of the target to be recorded (the position for ink ejection) and the space that the ink (droplet) can fly, that is to say, the region from the ink ejecting surface of the recording head 11 to the surface of the target to be recorded or the virtual surface that the ink can fly. It is also possible to use the recording surface such as the surface of a recording medium as the virtual surface or the position for ink ejection.

In the example shown In FIG. 1, the recording sheet P is used as the recording medium (ink receiving member). The printer 10 is designed to eject ink for image recording onto a recording medium other than a human body. When a human body exists in the ink ejection region (i.e., when the recording head 18 faces a human body), no ink is ejected. (That is, ink ejection (image recording) is not started. If recording Is being performed, ink ejection is prohibited or stopped.)

In the printer 10, the IR sensor 20 detects the intensity of IR from the ink ejecting direction, whereby it is determined whether there is a human body in the ink ejection region or not. When a human body is detected, no ink is ejected from the recording head 18.

In the present invention, there is thus provided a detection unit for detecting the condition of the ink election region including the target position for ink ejection, whereby it is possible to realize a safe (ink jet) printer (liquid droplet ejecting apparatus) of the type in which ink is basically ejected into an open space, as is the case with a printer using various types of recording medium including diverse recording sheets such as image receiving paper and recording paper, three-dimensional objects such as a plate, various image receiving media such as a wall, and so forth without being restricted in terms of thickness, toughness, etc., or a printer which can be moved to an arbitrary place in order to record an image, such as the above-mentioned electronic stamp; wherein Inadvertent ejection of ink can be prevented, and wherein it is possible to prevent ink from being ejected/sprayed to a location inappropriate as the recording medium, such as human skin or clothes, or into the air in the interior of a room, etc.

In the present invention, there are no particular limitations regarding the IR sensor 20 used. It is possible to utilize various well-known sensors for human body detection by IR, such as a thermopile utilizing thermo-electromotive force or a pyroelectric sensor utilizing the pyroolectric effect.

The human body detection method is not restricted to the one utilizing IR; various other methods can be adopted. It is possible to determine whether a human body exists in the ink ejecting direction or not by, for example, a method according to which carbon dioxide is detected by using a metal oxide sensor, or a method according to which light is applied in the ink ejecting direction to measure the quantity of reflected light.

In the present invention, the detection unit for detecting the condition of the ink ejection region including the target position is not restricted to the human body detection unit. For example, it is possible to detect the position of the recording medium existing in the target position for ink ejection or the ink election region from the printer, or the positional relationship between the printer and the recording medium so as to prohibit or stop ink ejection depending on the detection result.

In a preferred method, for example, a contact sensor for detecting contact with a recording medium, a micro switch turning on (or off) upon contact with an object, or the like is mounted to the leg portion 14, the main body 12, etc.; when the contact sensor and the recording medium are not in contact with each other or when the micro switch has not been properly turned on, ink ejection is prohibited or stopped.

In this case, it is desirable to arrange two, more preferably, three or more contact sensors or the like in positions spaced apart from each other, judging the condition as inappropriate unless all the contact sensors or the like are in the appropriate state. In the case in which the detection unit comes into contact with the recording medium, it is desirable for the detection unit to be arranged in a position where it does not come into contact with the recording medium immediately after ink ejection.

Also preferred is a method according to which a distance measuring means is used as the detection unit to detect the distance between the recording head 18 (e.g., its ink ejecting surface) and the recording medium, ink ejection being prohibited or stopped when the distance is not in an appropriate range.

In this case, there is no particular limitation regarding the appropriate distance; it can be appropriately set according to the properties, etc. of the recording head. Further, there is no particular limitation regarding the distance measuring method. It is possible to adopt a well-known means, such as an optical distance sensor based on the triangulation principle or an acoustic distance sensor.

Figure 6:
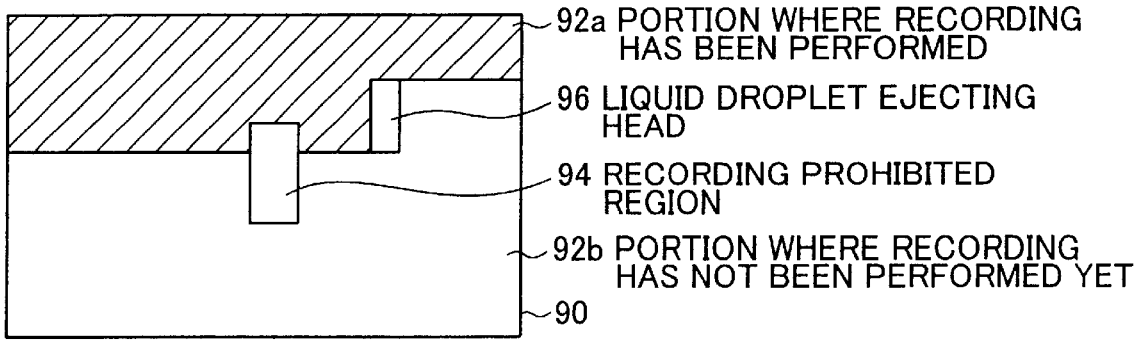
FIG. 6 is a diagram illustrating the operation of an ink jet printer according to the present invention.

As shown in FIG. 6, when printing is performed using the interior 90 of a room in a building as a recording medium, it is necessary to distinguish a region 92 where recording is to be performed such as a wall onto which ink is to be ejected from a recording prohibited region 94 as a portion onto which no ink is to be ejected, for example, a window, a window frame, an electrical outlet, an air inlet, a baseboard, and other attachments, 50 as to control the prohibition of ejection from at least part of the ejecting head 96, namely, the prohibition of ejection from a part or the whole of the nozzles in the liquid droplet ejecting head 96. In FIG. 6, the reference character 92*a* denotes a portion of the region 92 where recording is to be performed, in which recording has already been performed, and the reference character 92*b* denotes a portion of the region 92, in which recording has not been performed yet.

In this case, it may be possible in general to previously designate the region 92 where recording is to be performed and the recording prohibited region 94 as shown in FIG. 6 by a coordinate system or the like. Such a method, however, requires not only accuracy of the recording apparatus but also accuracy in the positional relationship between the recording apparatus and the recording medium such as a building, resulting in a rather expensive apparatus and rather poor operability. Further, it takes a long time before recording is started.

To solve this problem, according to the present invention, variations in the condition of the recording medium are detected by the detection unit, and ejection is controlled (i.e., it is determined whether recording is to be performed or not) based on the condition detected, thereby making it possible to perform recording exclusively in the portions where it is necessary, as shown in FIG. 6.

Examples of the detection unit for detecting the condition of the recording medium include the following, as classified inclusive of the IR sensor 20, the distance measuring means and the positional relationship detection unit such as a contact sensor as described above:

(1) those utilizing optical factors (reflectance, color, IR, etc.);

(2) those based on surface roughness;

(3) those utilizing (super-) sonic wave; and (4) those utilizing temperature.

Further, when making a judgment as to whether ejection is to be prohibited or not by such a detection unit as above, it is more desirable to use a threshold value, changing it according to the circumstances. For example, when recording is to be performed on the interior 90 of a room in a building as shown in FIG. 6, it is desirable to previously measure the condition of the recording medium in the region 92 where printing (recording) is to be performed and in the recording prohibited region 94 where printing is to be prohibited by means of the detection unit for detecting the condition of the recording medium, provided in the liquid droplet ejecting apparatus, as scanning a destined recording surface using the liquid droplet ejecting apparatus caused to eject no ink, and determine the threshold value for prohibiting election on the basis of the measurement result. On that occasion, an ejection prohibited portion, which is defined based on the threshold value thus determined, may be confirmed with, for instance, a CRT monitor to partially add recording prohibition data or partially delete ejection prohibition data. Alternatively, the condition of the recording medium may be monitored during recording to make a judgment as to whether the recording is to be prohibited or not on the basis of the previously set threshold value.

Further, it is more desirable that the detection unit is capable of detecting a plurality of areas so that the above judgment may be made corresponding to the position in the head (nozzle row). For example, when the recording has approached the border between the wall and the window frame, it is preferable to control the ejection prohibition so that the ejection from the nozzles at the forward end with respect to the head advancing direction is prohibited whereas the ejection from the nozzles in the middle portion and at the rear end is continued.

While in the various examples described above the condition of the recording medium opposed to the ejecting head is detected by the detection unit, and ink ejection is prohibited depending on the detection result, this should not be construed restrictively. It is also possible to detect the condition of the ejecting head itself and prohibit ink ejection depending on the detection result. Examples of the detection unit for detecting the condition of the ejecting head itself include a detection unit for detecting the direction in which liquid droplets are ejected from ejecting head.

The detection unit for detecting the direction in which liquid droplets are elected from the ejecting head may be an angle detection unit, for instance. As a preferred example of the angle detection unit, a means for measuring the angle made by a weight mounted to the head main body and the vertical direction may be mentioned, with which the angle made by the ink ejecting direction and the vertical direction is suitably detected so as to prohibit or stop the ejection of ink in case the angle is inappropriate.

For example, in a case of a printer which records an image on a recording medium placed on a desk or the like, the ink ejecting direction and the vertical direction are usually substantially the same, and when the angle made by the ink ejecting direction and the vertical direction is too large, the ejection of ink is prohibited or stopped. In contrast, in a case of a printer which records an image mainly on a wall surface, screen or the like, the angle made by the ink ejecting direction and the vertical direction is usually approximately 90 degrees because of the ink ejecting direction being substantially horizontal, so that when this angle is deviated from 90 degrees by not less than a predetermined angle, the ejection of ink is prohibited or stopped.

There is no particular limitation regarding the angle made by the vertical direction and the ink ejecting direction; it is appropriately determined depending on the recording medium for which the printer is mainly intended and the usual condition in which the printer is used. The angle detection unit may be a well-known one.

Further, there is no particular limitation regarding the permissible angle range. However, to secure a sufficiently high level of safety, it is desirable for the range to be approximately ±5 degrees with respect to the ideal angle for recording.

While in the examples as described above, the angle made by the ink ejecting direction in reference to the vertical direction is found, this should not be construed restrictively. It is also possible to previously set a given direction as the reference direction and find the angle made by the ink ejecting direction with respect to the reference direction. If the reference direction is set to the proper (or correct) ink electing direction, the angle made by the reference direction and the actual ink ejecting direction can be regarded as the deviation from the reference angle. On that occasion, it is suitably possible to deal with the case where ink is ejected in the vertical direction to record an image on a recording medium placed on a desk or the like and the case where ink is ejected in the horizontal direction making an angle of 90 degrees to the vertical direction to record an image on a wall surface, a screen, or the like in a similar manner and set the permissible angle range on the similar criteria.

It goes without saying that the present invention allows a concurrent use of a plurality of detection units for detecting the condition of the ink ejection region including the target position.

The present invention will be described in more detail through description of the operation of the printer 10 with reference to FIG. 3.

When the power of the printer 10 is turned on, the indicator 46 gives various indications (e.g., whether printing is possible or not or whether there is any image data or not), and the CPU 30 resets an ejection prohibition flag, the abnormality indication of the abnormality indicator 38 being extinguished.

It is also possible to enable the user to select the image to be recorded and input the number of prints as needed. This can be conducted by a well-known method such as GUI (graphical user interface) using the indicator 46.

Next, it is checked whether there exists any image data in the data memory 44 and, further, whether it is image data corresponding to the recording; when no image data corresponding to the recording is stored, image data is supplied to the data memory 44 from the data input portion 42.

The supply of image data may be effected by a well-known method, such as wired or wireless downloading, or reading from the recording medium installed. The image data supply source may be the same as that of various types of printer for a scanner (image reading device), computer, digital camera, communications network, etc. Further, it is also possible to store, apart from the image data supplied, image data of a predetermined pattern, and perform image recording with image data of this pattern.

When image data corresponding to the recording exists in the data memory 44, and the recording instruction switch 40 is on, IR measurement in the ink ejection region including the target position is performed by the IR sensor 20. Alternatively, the IR sensor 20 may constantly perform measurement, the CPU 30 confirming the output thereof.

The recording instruction switch 40 may be turned on/off by the user, or may be automatically turned on/off according to the condition of the printer 10, for example, whether recording is possible or not.

There is no particular limitation regarding the timing of the measurement by the IR sensor 20. In a preferred arrangement, measurement is performed by the IR sensor 20 each time the printer 10 is moved by the user in the scanning direction (the direction of the arrow b) by a predetermined amount, that is, each time a predetermined number of pulse signals have been generated by the rotary encoder 50.

It is also desirable that measurement be performed by the IR sensor 20 for a predetermined time interval or a predetermined number of clocks.

The measurement result (output signal) obtained by the IR sensor 20 is converted to a digital signal by the A/D converter 34 and transmitted to the CPU 30.

The CPU 30 confirms the measurement result; when the measured IR is not higher than a set value (threshold value), the driver 32 is driven in synchronism with the movement of the printer 10 by the user, namely the generation of the pulse signals by the rotary encoder 50, and with modulation in accordance with the image to be recorded to thereby cause the recording head 18 to eject ink with modulation in accordance with the image to be recorded for a predetermined period of time (in a predetermined number of lines).

The IR measurement timing and the ink ejecting time are appropriately set according to the required level of safety, etc.

In the preferred example shown, the intensity (the set value) of IR at which it is determined that there exists a human body can be arbitrarily set by the detection level setting device 36. However, this should not be construed restrictively. It is also possible for a fixed value to be set according to the target level of safety, etc.

When, after ink has been ejected with modulation in accordance with the image for a given period of time, there remains in the data memory 44 data on the image to be recorded, the operations from the measurement by the IR sensor 20 to the ink ejection are repeated as long as the measurement value obtained by the IR sensor 20 does not exceed the set value. When the ink ejection for all the image data of this image has been completed, the recording of this image is completed, and it is checked whether there is in the data memory 44 data on the image to be recorded next or not; when image data exists, and recording instruction has been issued, image recording is performed in the same manner as described above. When image recording has been performed upon turning on of the forced recording switch described below (forced recording) and the recording of an image has been completed, the abnormality indication is extinguished, and the data memory 44 is checked, image recording being performed in the same manner.

Upon the completion of the recording, the image data is erased from the data memory 44 automatically or upon instruction by the user. It is desirable for the erasure of image data to be selectable.

When the measurement IR value obtained by the IR sensor 20 exceeds the set value, the CPU 30 determines that there is someone in the ink ejecting direction, and gives abnormality indication through the abnormality indicator 38.

After warning through abnormality indication, alarm, etc., the CPU 30 checks the forced recording switch 48. When the forced recording switch 42 is on, ink is ejected for a predetermined time as described above independently of the abnormality detection, and image recording is forcibly performed.

When the forced recording switch is off, the CPU 30 forcibly turns off the recording instruction switch 40, and image recording is not performed (ink election is not started; when recording is being performed, ink ejection is prohibited or stopped), the image data inclusive of the data on images already recorded being retained in the data memory 44. Then, the recording prohibition flag is set, and warning is given by an alarm, the image recording being forcibly terminated.

In this case, image recording may be resumed after some instruction has been input by the user (e.g., by turning on the recording instruction switch 40). Alternatively, it is also possible to automatically turn off the power of the printer 10 simultaneously with the forced termination of the image recording and to resume image recording after the power has been turned on again by the user.

Figure 4A:
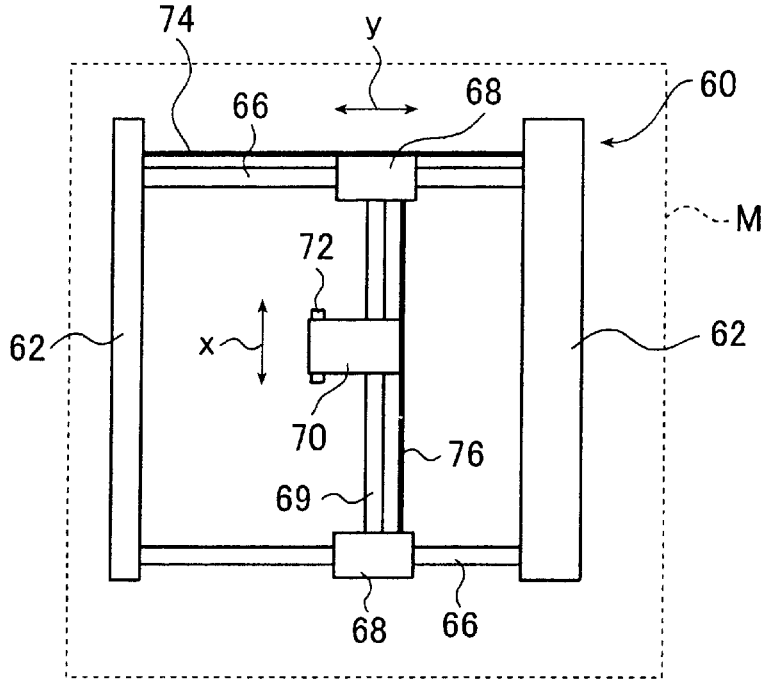
Figure 4B:
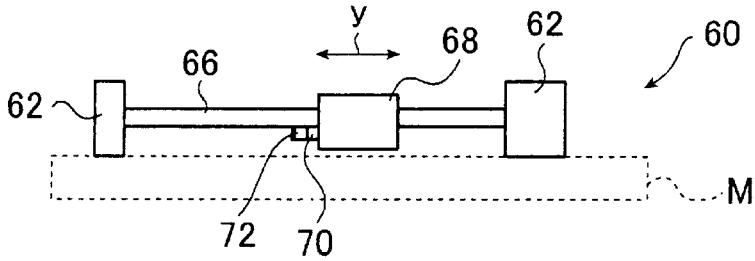

FIGS. 4A and 4B are conceptual drawings showing another embodiment of an ink jet printer according to the present invention. FIG. 4A is a plan (top) view, and FIG. 4B is a side view.

While in the above-described printer 10 image recording is performed by manually moving the printer 10 in a predetermined scanning direction, the ink jet printer 60 shown in FIGS. 4A and 4B (hereinafter referred to as the printer 60) is installed in a place corresponding to the recording medium M (or the image recording position thereof), and then the (ink jet) recording head is moved two-dimensionally as in an x-y plotter, thereby performing image recording.

The printer 60 shown in FIGS. 4A and 45 comprises two bases 62 extending in a direction (the direction perpendicular to the plane of FIG. 4B, hereinafter referred to as the x-direction) and arranged in parallel so as to be spaced apart from each other, two first guide arms 66 extending in a direction perpendicular to the x-direction (hereinafter referred to as the y-direction) in the vicinity of the ends with respect to the direction in which the bases 62 extend and secured to the two bases 62 so as to bridge between them, sliders 69 respectively held by the guide arms 66 so as to be slidable in the y-direction, a second guide arm 69 extending in the x-direction and supported by the sliders 68, and a head unit 70 supported by the second guide arm 69 so as to be movable in the x-direction.

Although not shown, a recording head is arranged on the lower surface of the head unit 70.

The recording head is arranged so as to eject ink in a direction perpendicular to the plane defined by the bases 62 and the guide arms 66 (That is, ink is ejected into an open space outside the printer 60). As in the case shown in FIGS. 1A through 1C, the recording head used is a well-known one; in the example shown, it has four nozzle rows for C, M, Y, and K ink extending in the y-direction.

Further, the head unit 70 is equipped with a distance sensor 72 as a detection unit for measuring the distance between it and the object situated below (the ink ejection region).

The distance sensor 72 may be one as used in the above-mentioned embodiment. Apart from the distance sensor, the detection unit may consist of an IR sensor, contact sensor, etc., as in the above-described case. Such a detection unit may be naturally arranged on the bases 62, the guide arms 66, etc. according to the detection method, etc.

The bases 62 have a well-known wire driving means using a wire 74, by means of which the sliders 68 movably held by the guide arms 66 are moved in the y-direction. Further, the sliders 68 have a well-known wire driving means using a wire 76, by means of which the head unit 70 movably held by the second guide arm 69 is moved in the x-direction.

That is, the head unit 70 having a recording head on its lower side is moved two-dimensionally over the recording medium M by the two wire driving means.

Thus, in the printer 60, the head unit 70 is moved in the x-direction to perform image recording as in the above-described serial type (ink jet) printer. Then, the sliders 68 (head unit 70) are moved in the y-direction by a predetermined amount corresponding to the nozzle row length, and the head unit 70 is moved in the x-direction to repeat image recording, thereby two-dimensionally recording an image on the recording medium M.

In the printer 60, ink is basically ejected to perform image recording when the measurement result obtained by the distance sensor 72 indicates that the distance between the object facing the recording head (ink ejection surface) and the ink ejection surface is in a predetermined range. When this distance is outside the predetermined range, ink ejection is inappropriate, so that no ink is ejected (If recording is being performed, the ejection of ink is prohibited or stopped).

Alternatively, it is also possible to adopt an arrangement in which the position of the recording head is adjustable in the ink ejecting direction, the ejection of ink being prohibited or stopped when an adjustment range measured by the distance sensor 72 is exceeded.

Figure 3:
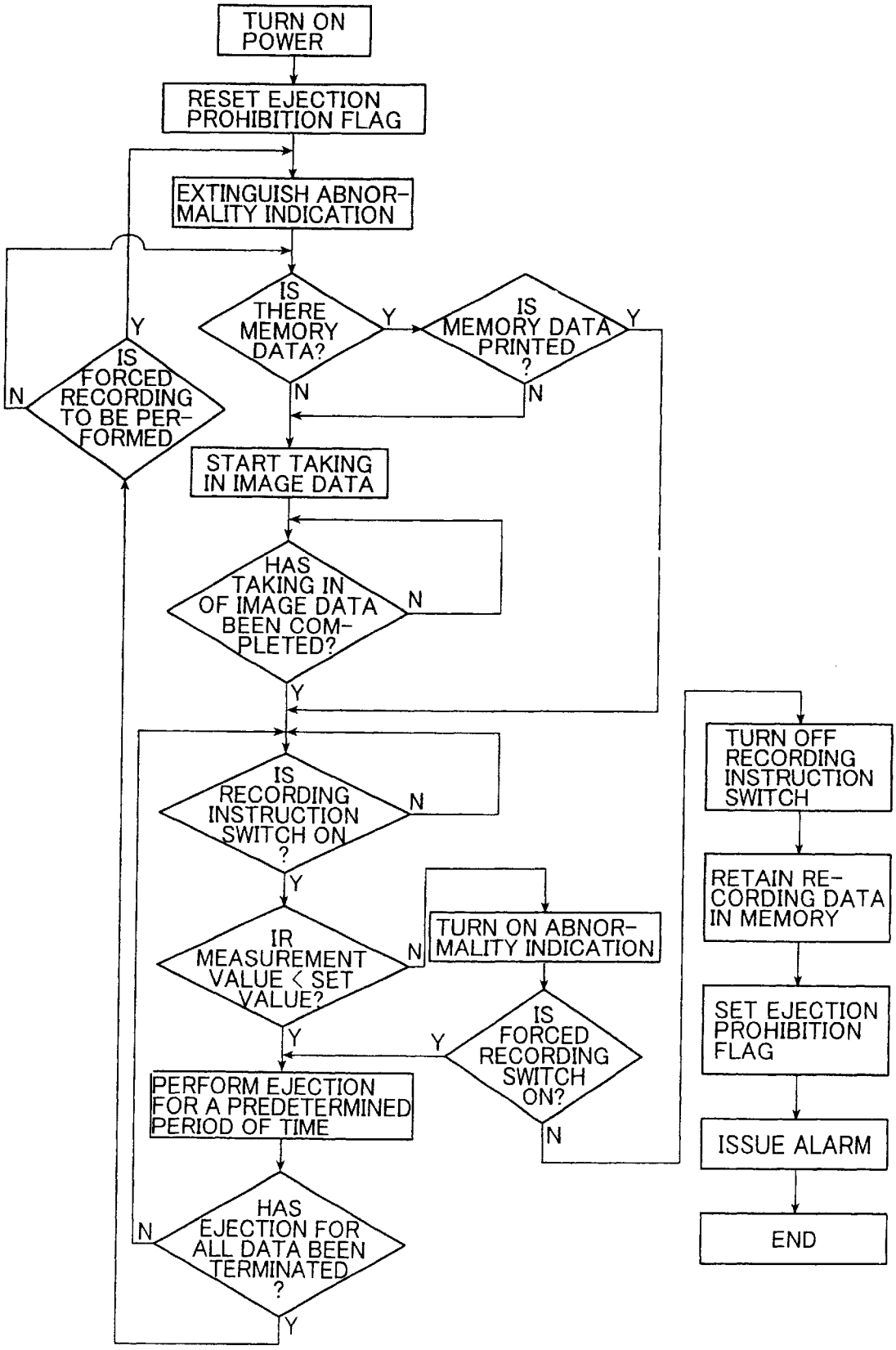
FIG. 3 is a flowchart for illustrating the operation of the ink jet printer shown in FIGS. 1A, 1B, and 1C.

The sequence in this case may, for example, be that of the flowchart of FIG. 3 described above.

Thus, in this embodiment also, the ejection of ink (image recording) is performed only when the recording medium M is properly situated in the ink ejection region or the target position for ink ejection, whereby it is possible to realize a printer 60 with high level safety so that ink is prevented from being sprayed onto a human body or into the air.

While the above-mentioned (ink jet) printers of the present invention record images on planes, this should not be construed restrictively It is also possible to perform image recording simultaneously on a plurality of surfaces of a three-dimensional object.

Figure 5A:
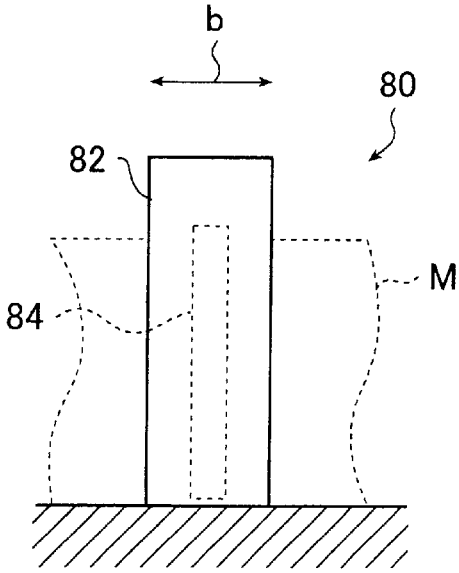
Figure 5B:
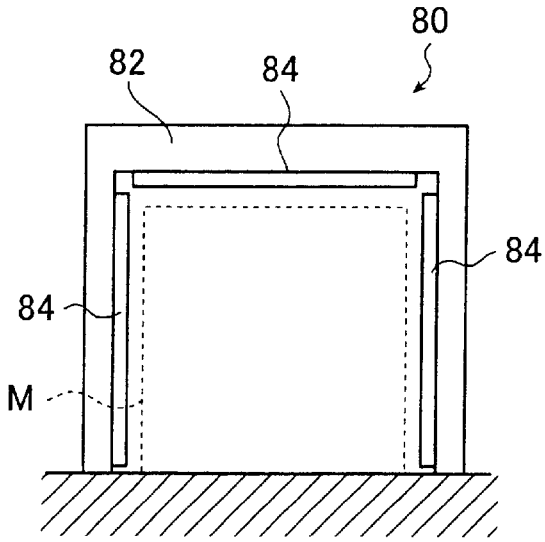

For example, the printer 80 shown in FIG. 5A (side view) and FIG. 5B (front view) uses a rectangular frame 82, and recording heads 84 are arranged on two opposing inner side surfaces and the ceiling surface of this frame 82. The recording heads 84 have nozzle rows extending in the scanning direction indicated by the arrow b (the direction perpendicular to the plane of FIG. 5B), and are arranged so as to eject ink in directions perpendicular to the inner wall surfaces of the frame 82. Thus, in the printer 80 also, ink is ejected into an open space according to the size of the frame 82.

In this printer 80, a recording medium M having a rectangular section is inserted into the frame 82, and a relative movement is effected in the scanning direction between the frame 82 and the recording medium M, and, in synchronism with this movement, ink is ejected from the recording heads 84 with modulation in accordance with the image to be recorded, whereby ink jet images can be recorded on three surfaces of the recording medium M.

The above-mentioned relative movement (scanning) can be effected by moving the frame or the recording medium M.

In this printer 80 also, a detection unit for detecting the condition of the ink ejection region including the target position is arranged, for example, on the ceiling surface of the frame 82; when the ink ejection region or the target position is not in a predetermined condition, the ejection of ink is prohibited or stopped.

Due to this arrangement, it is possible to realize a printer 80 with high level safety so that inadvertent ink ejection is prevented, for example, when an inappropriate recording medium is inserted into the frame 82 or when there is no recording medium in the frame 82.

While in the above-described examples the liquid droplet ejecting apparatus of the present invention is applied to ink let printers, this should not be construed restrictively. The present invention is applicable to various types of liquid droplet ejecting apparatus as long as they have nozzles for ejecting liquid droplets and liquid droplet ejecting devices corresponding to the respective nozzles.

For example, the present invention is suitably applicable to an apparatus for applying adhesive in minute patterns.

The liquid droplet ejecting apparatus of the present invention, described in detail above, is not restricted to the above embodiments. It goes without saying that various improvements and modifications are possible without departing from the scope of the invention.

For example, while the printer 10 shown in FIGS. 1A through 1C and FIG. 2 is manually moved by the user, it is also possible to realize a self-propelled printer by, for example, engaging the rollers 16 with a driving means.

Further, the printer 60 shown in FIGS. 4A and 4B may adopt a so-called line head having an elongated nozzle row extending, for example, in the x-direction, image recording being performed on the recording medium solely through movement of the line head in the y-direction.

As described in detail above, in the liquid droplet ejecting apparatus of the present invention, the condition of the region or the position for ejecting droplets of liquid such as ink is detected, and when the detection result indicates that the ejection of liquid droplets is not appropriate, the ejection of liquid droplets is prohibited or stopped. Thus, the liquid droplet ejecting apparatus of the present invention makes it possible to realize an ink jet printer, an adhesive applying apparatus, etc. with high level safety so that liquid droplets are prevented from being inadvertently ejected onto an unwanted location such as a human body or into the air.

What is claimed is:

1. A liquid droplet ejecting apparatus comprising:

an ejecting head having a plurality of nozzles for ejecting liquid droplets and a plurality of liquid droplet ejecting devices arranged in correspondence with said plurality of nozzles, respectively, and driven with modulation in response to signals;

a detection unit for detecting a condition of a virtual surface opposed to said ejecting head; and a unit for prohibiting liquid droplet ejection from at least a part of said plurality of nozzles of said ejecting head depending on a result or detection by said detection unit.

2. The liquid droplet ejecting apparatus according to claim 1, wherein said detection unit is a unit for detecting a human body.

3. The liquid droplet ejecting apparatus according to claim 1, wherein said detection unit is a unit for measuring a distance between an object existing in a liquid droplet ejection region for said plurality of nozzles of said ejecting head and said ejecting head.

4. The liquid droplet ejecting apparatus according to claim 1, wherein said detection unit is a variation detection unit for detecting variations in a condition of a recording medium to be recorded existing in a liquid droplet ejection region for said plurality of nozzles of said ejecting head.

5. The liquid droplet ejecting apparatus according to claim 1, wherein liquid droplets are ejected from said ejecting head into an open space.

6. The liquid droplet ejecting apparatus according to claim 1, wherein said liquid droplets are ink droplets, and wherein said liquid droplet ejecting apparatus is an ink jet printer.

7. A liquid droplet ejecting apparatus comprising;

an ejecting head having a plurality of nozzles for ejecting liquid droplets and a plurality of liquid droplet ejecting devices arranged in correspondence with said plurality of nozzles, respectively, and driven with modulation in response to signals;

an angle detection unit for detecting an angle made by a direction, in which liquid droplets are ejected from at least a part of said plurality of nozzles of said ejecting head, and a preset reference direction; and a unit for prohibiting liquid droplet ejection from at least a part of said plurality of nozzles of said ejecting head depending on an angle detected by said angle detection unit.

8. The liquid droplet ejecting apparatus according to claim 7, wherein said preset reference direction is a vertical direction.

9. The liquid droplet ejecting apparatus according to claim 7, wherein liquid droplets are ejected from said ejecting head into an open space.

10. The liquid droplet ejecting apparatus according to claim 7, wherein said liquid droplets are ink droplets, and wherein said liquid droplet ejecting apparatus is an ink jet printer.

* * * * *

UNITED STATES PATENT AND TRADEMARK OFFICE

CERTIFICATE OF CORRECTION

PATENT NO. : 6,543,874 B2
DATED : April 8, 2003
INVENTOR(S) : Matsumoto

It is certified that error appears in the above-identified patent and that said Letters Patent is hereby corrected as shown below:

Column 13,
Lines 47 and 48, replace text with -- depending on a result of detection by said detection --.

Signed and Sealed this

Ninth Day of September, 2003

JAMES E. ROGAN
*Director of the United States Patent and Trademark Office*